United States Patent [19]

Robb et al.

[11] Patent Number: 4,583,685

[45] Date of Patent: Apr. 22, 1986

[54] RAIL ANCHORING

[75] Inventors: Dennis M. Robb; Peter K. Wilson, both of Croydon, Australia

[73] Assignee: The Broken Hill Proprietary Company Limited, Melbourne, Australia

[21] Appl. No.: 680,587

[22] Filed: Dec. 11, 1984

Related U.S. Application Data

[63] Continuation of Ser. No. 446,980, Dec. 6, 1982, abandoned.

[51] Int. Cl.[4] ..... E01B 3/16; E01B 9/48

[52] U.S. Cl. ..... 238/54; 238/59; 238/264; 238/287; 238/349

[58] Field of Search ..... 238/56, 54, 59–61, 238/349, 351–352, 287, 284, 264

[56] References Cited

U.S. PATENT DOCUMENTS

| | | | |
|---|---|---|---|
| 638,922 | 12/1899 | Gregg . | |
| 688,904 | 12/1901 | Vachon . | |
| 905,624 | 12/1908 | Ambert . | |
| 1,046,837 | 12/1912 | Morgan . | |
| 1,670,994 | 5/1928 | Snyder et al. . | |
| 1,741,005 | 12/1929 | Adams . | |
| 1,851,638 | 3/1932 | Mayo . | |
| 2,107,131 | 2/1938 | Schwinn | 238/349 |
| 2,944,739 | 7/1960 | Schwinn | 238/217 |
| 3,021,076 | 2/1962 | Finch | 238/321 |
| 3,442,452 | 5/1969 | Harmsen | 238/349 X |
| 3,664,584 | 5/1972 | Novotny | 238/349 |

FOREIGN PATENT DOCUMENTS

| | | |
|---|---|---|
| 76932/81 | 5/1982 | Australia . |
| 83610/82 | 12/1982 | Australia . |
| 88549/82 | 12/1982 | Australia . |
| 2718665 | 11/1978 | Fed. Rep. of Germany . |

*Primary Examiner*—Randolph A. Reese
*Assistant Examiner*—Glenn B. Foster
*Attorney, Agent, or Firm*—Murray, Whisenhunt and Ferguson

[57] ABSTRACT

A rail anchoring clip and sleeper assembly comprising a sleeper and at least one rail anchoring clip arranged in use to longitudinally anchor a rail across the sleeper, the sleeper having means to locate the rail in a direction longitudinal of the sleeper and means to locate the clip in a direction lateral of the sleeper, the clip being constructed of resilient material and being shaped when resiliently deformed in use to define a first portion that bears tightly against the upper surface of one side of the rail foot, a second portion that bears tightly against the underside of the sleeper to compressibly anchor the rail onto the sleeper and a third portion in cooperative engagement with said means to locate said clip laterally of the sleeper, the positions of contact of the first, second and third portions with the rail and sleeper respectively being spaced apart in a direction longitudinal of the sleeper.

22 Claims, 5 Drawing Figures

RAIL ANCHORING

Figure 1:
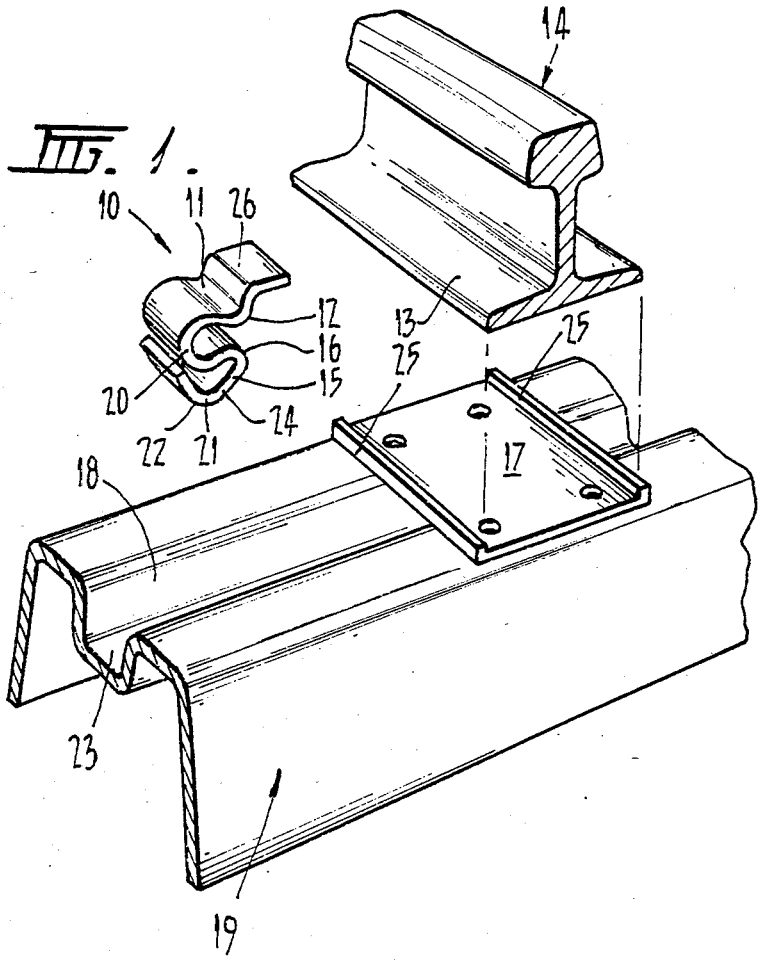

This application is a continuation of application Ser. No. 446,980, filed Dec. 6, 1982, now abandoned.

This invention relates rail anchoring, and more particularly, but not exclusively, to a resilient rail anchoring clip for rail systems subjected to low to medium axle loads, said clip also being capable of cooperating with sleepers of any material and adapted, in use, to co-operate with a sleeper having a channel or recess extending longitudinally thereof, at least over those portions thereof at which, in use, a rail is to be positioned. This invention also relates to rail anchoring assemblies incorporating the clip and sleeper.

Conventional resilient rail clips are sprung into position on either side of the foot of a rail by torsion or bending effects with one part of the clip bearing hard against the upper surface of the rail foot, another part of the clip being attached to the sleeper and bearing upwardly, whilst the final part of the clip bears down on the associated sleeper to balance the forces generated within the clip.

The effect of the above forces is to induce additional stress in the area of the sleeper on which the rail is seated.

Some types of such known clips are those manufactured by Pandrol Limited of Britain under the name of Pandrol (trade mark); Portec (Aust.) Pty. Ltd. under the name Side-winder (trade Mark); Omark (Australia) Limited under the name "Trak-Lok" (trade mark); and by B. V. Schroefboutenfabriek v. h. Everts en van der Weijden of Holland under the name D. E. Springclips, although less sensitive to variations in rail thickness, still impose additional stresses in the rail seat area of the sleeper.

All of the above known types of rail clips act to hold the rail foot against the sleeper against lifting forces and forces transverse of the rail direction, but in order to restrain the rail clip from moving longitudinally of the rail direction high toe loads (the loads applied on the upper surface of the rail foot) are necessary.

Other types of rail clips, commonly called rail anchors, are known and are formed in one piece to extend beneath the rail foot and engage on, or about, the edges of the rail foot, whilst bearing against the side faces of the sleeper. Such rail anchors act to restrain the rail against longitudinal movement, but additional hold-down clips or spikes are required to restrain the rail against lifting and transverse movements.

According to one aspect of the present invention, there is provided a rail anchoring clip and sleeper assembly comprising a sleeper and at least one rail anchoring clip arranged in use to longitudinally anchor a rail across the sleeper, the sleeper having means to locate the rail in a direction longitudinal of the sleeper and means to locate the clip in a direction lateral of the sleeper, the clip being constructed of resilient material and being shaped when resiliently deformed in use to define a first portion that bears tightly against the upper surface of one side of the rail foot, a second portion that bears tightly against the underside of the sleeper to compressibly anchor the rail onto the sleeper and a third portion in cooperative engagement with said means to locate said clip laterally of the sleeper, the positions of contact of the first, second and third portions with the rail and sleeper respectively being spaced apart in a direction longitudinal of the sleeper.

Preferably, the means to laterally locate the clip comprises a channel formed longitudinally of the sleeper and the means to locate the rail comprises a base plate secured to the sleeper to extend laterally of the sleeper over the upper surface of the channel, the base plate having upturned flanges on each side between which the foot of the rail is arranged to be located.

According to a further aspect of the present invention, there is provided a rail anchoring clip adapted, in use, for cooperation with a sleeper and a rail, the sleeper having means to locate the rail in a direction longitudinal of the sleeper and means to locate the anchoring clip in a direction lateral of the sleeper, the anchoring clip being formed of a strip of resilient material and being shaped to provide, when resiliently deformed in use, a first portion arranged to bear tightly against the upper surface of one side of the rail, a second portion arranged to bear tightly against the underside of the sleeper to compressibly anchor the rail onto the sleeper and a third portion arranged to be in cooperative engagement with said means to locate said clip laterally of the sleeper, the positions of contact of the first, second and third portions with the rail and sleeper respectively being spaced apart in a direction longitudinal of the sleeper.

The invention also envisages an assembly of a rail and a sleeper incorporating a rail anchoring clip as hereinbefore defined.

Figure 2:
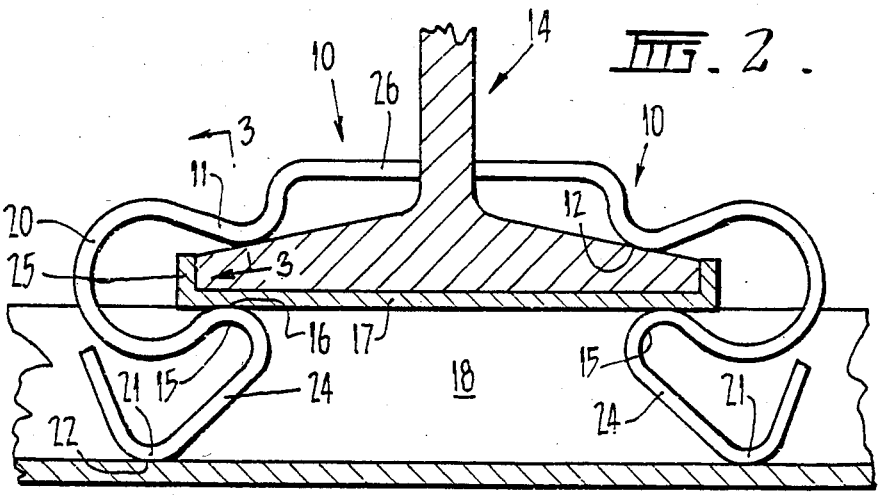
Figure 3:
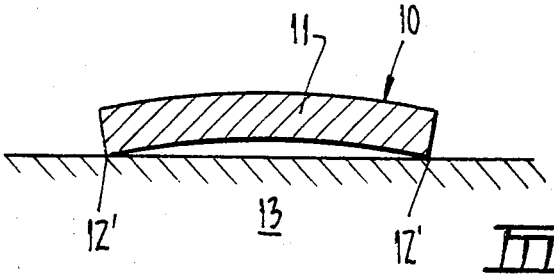
Figure 4:
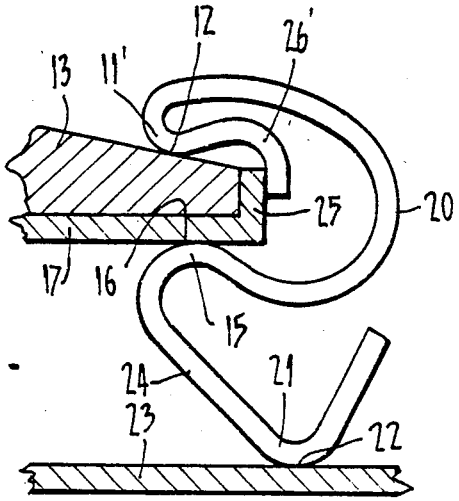
Figure 5:
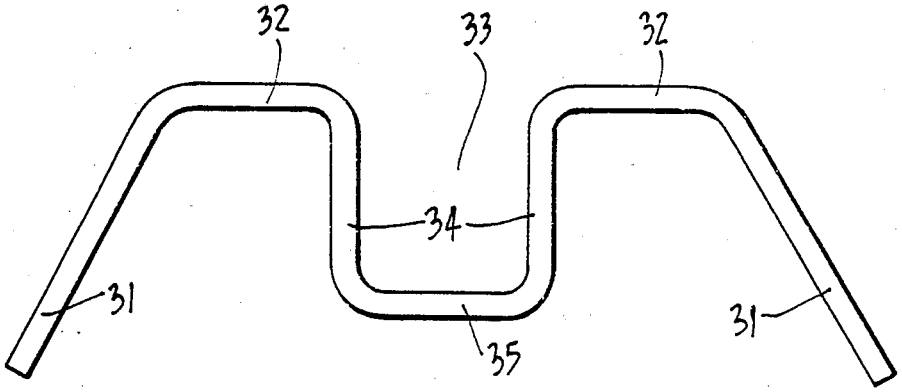

Various embodiments of the invention will now be described with reference to the accompanying drawings, in which;

FIG. 1. is an exploded view of an anchoring clip and sleeper constituting one embodiment of the invention, together with an associated rail, FIG. 2, is a detailed cross-sectional view of the assembly of FIG. 1, FIG. 3, is a cross-sectional view along line 3—3 of FIG. 2, FIG. 4, is a detailed cross-sectional view of an alternative form of clip configuration in an assembly of rail, clip and sleeper assembly, and FIG. 5, is an end view of an improved sleeper for use with clips of the kind illustrated in FIGS. 1, 2 and 4.

Referring to FIGS. 1 and 2 of the drawings, there are shown exploded and assembled views of the rail, sleeper and clip assembly in accordance with one preferred embodiment of the invention.

The anchoring clip, generally indicated as 10, is formed from a strip of spring steel (approximately 25 mm wide and 4–5 mm thick), which is bent to adopt a generally S-shaped configuration as shown. Portion of the clip adjacent one end is bent at 11 to provide line contact 12 against the upper surface of one side of the foot 13 of an associated rail 14. A portion of the strip intermediate of its length is bent at 15 to provide line contact 16 against the underside of a plate member 17 which straddles a channel 18 in a steel sleeper 19, which plate member is affixed to the sleeper, for example by welding. A portion 20 of the clip between the portion 11 and the intermediate portion 15 is of generally circular configuration as shown and loops around the combination of the rail and plate edges. A portion of the clip adjacent the other end of the strip is bent at 21 to provide line contact 22 against the bottom 23 of the channel 18 in the sleeper. A portion 24 of the clip between the intermediate portion 15 and the portion 21 is of straight configuration and acts as a strut or "barb" between the underside of the plate and the bottom of the channel to resist any tendency of the clip to be pulled or slid out of position.

The plate member 17 has shallow upstanding shoulders 25 formed along each edge transverse to the groove 18 and adjacent which the side edges of the rail foot 13 are positioned to provide positive gauge restraint to the rail.

As shown in FIG. 2 an identical clip is positioned on the opposite side of the rail foot and plate member combination to complete the rail fastening assembly at that point.

In the unstressed condition of the clip, and in a situation where the depth of the channel 18 in the associated sleeper is to be 35 mm plus or minus 0.5 mm, the vertical distance between the line contacts 16 and 22 with the underside of the plate 17 and the bottom 23 of the channel respectively, should be in the order of 36 mm plus or minus 0.5 mm so that when the clip is driven into position it will be resiliently deformed and placed under stress to bear tightly against the underside of the plate and the bottom of the channel. Furthermore, in the unstressed condition of the clip, the vertical distance between the line contacts 12 and 16 with the upper surface of the rail foot and the underside of the plate respectively, should be between 1 to 10 mm, but normally in the order of 5 mm, less than the height of the rail foot and plate combination at the required position for the clip so that when the clip is driven into position it will be resiliently deformed and placed under stress to bear tightly against the upper surface of the rail foot and the underside of the plate. In this example, the horizontal distance between the line contact 12 with the upper surface of the rail foot is 3 mm further inwardly of the rail foot from the line contact 16 with the underside of the plate, with the line contact 22 with the bottom of the channel being horizontally spaced outwardly of the rail a further 17 mm from the line contact 16. The effect of these spacings is to counteract any tendency for the upper portion of the clip to slide down the inclined upper surface of the rail foot, as such a tendency induces a rotational force on the clip about the line contact 16 on the underside of the plate member 17 thus causing the lower portion of the clip at its line contact 22 with the bottom of the channel to bear more tightly against the bottom of the channel thus resisting the clip movement.

It is believed that in most applications the frictional resistance generated by the force applied by the clip against the bottom of the channel at the line contact 22 will be sufficient to resist movement of the clip once it is driven into position, although in some applications it may be desirable to form a shallow depression, or an upstanding abutment, in the bottom of the channel with which the clip portion at the line contact 22 can positively engage to provide additional resistance to sliding at that point.

Finally, and in order to prevent the clip from being over-driven into position, the upper portion of the clip is provided with an extension 26, the end of which will abut the central web of the rail when the clip is in the correct position and thus preventing over-driving.

Alternatively, the upper portion of the clip may be reshaped as 11', as shown in FIG. 4, to bend away from the central web of the rail to still provide the line contact 12, but having an extension 26' which bears against the side of the upstanding shoulder 25 of the plate member 17 to prevent over-driving.

It is understood that the over-drive stop may be omitted the clip having inherent qualities to withstand over-drive forces particularly with regard to retention of the toe load.

The tight engagement of the clip about the edge of the rail foot and plate combination clamps the rail foot 13, and thus the rail 14, to the plate member 17, and thus the sleeper, to restrain the rail against lifting movements. The width of the clip relative to the width of the channel is such that its edges will lie in relatively close proximity to the side walls of the channel such that little, if any, movement of the rail relative to the sleeper, and longitudinally of the rail direction, is possible.

In the above described embodiments it is envisaged that line contacts will be formed between the clip and the rail foot, plate member and bottom of the channel. However, in practice the bending of the strip to form the clip tends to produce a slightly concave surface on the outer sides of the bends as shown in, but exaggerated in, FIG. 3. This has the effect of providing laterally spaced apart point contacts, such as 12 and 12' on the rail foot, at the side edges of the clip.

The use of the expression "line contact" throughout this specification is understood to embrace the situation illustrated in FIG. 3.

Although the invention has been described in relation to assemblies incorporating steel sleepers, the invention is also applicable to use in assemblies incorporating sleepers of other materials, for example, suitably formed concrete and timber sleepers and in which the longitudinal channel may be continuous or discontinuous to in effect provide recesses at the rail feet.

Preferably the clip is formed from either carbon steel, alloy steel or heat treated steel, although in some applications it may be formed from a plastics material.

The railway sleepers disclosed above are cold rolled from steel sheet, and incorporate channels having downwardly converging opposing side walls, whilst the depth of the channels are in the order of 65 percent of the total height of the sleeper.

When sleepers of this type are positioned on an underlying ballast bed, ballast material fills the space beneath and within the profile of the sleeper to provide a firm footing for the sleeper within the ballast. It is desirable to prevent movement of the sleeper within the ballast bed resulting from progressive settling or sinking within the ballast under the weight imposed by rolling stock thus causing undulations in the plane of the track top, and to prevent movement laterally of the track causing misalignment longitudinally of the track.

It has been discovered that such movements producing undulations in the top plane of the track, and misalignment longitudinally of the track, can be minimised, if not eliminated, by increasing the depth of the channel relative to the total height of the sleeper, thus increasing the area of surface contact with the underlying ballast resulting in higher friction forces opposing longitudinal movement of the sleeper within the ballast bed and therefore laterally of the track, whilst also opposing undesirable settling or sinking movements, which are also further resisted due to the situation of the bottom wall of the channel deeper within the ballast bed.

Therefore it is desirable to cold roll a sleeper having a longitudinal channel in the upper side thereof the depth of which is in excess of 65 percent of the total height of the sleeper.

Preferably the depth of the channel is in the order of 80 percent of the total height of the sleeper. The increased depth of the channel provides an additional advantage insofar as it increases the moment of inertia of the profile to resist bending of the sleeper under load.

Furthermore, with the assemblies illustrated above, in which the opposing side walls of the channel converge downwardly, the side edges of the portions of the rail anchoring clips which, in use, are received within the channel only engage lower portions of the side walls of the channel, thus resulting in a tendency for the clips to move or twist within the channels.

It is therefore desirable to provide a sleeper configuration or profile which at least minimises, if not eliminates, movement or twisting of an associated rail clip within the channel. Consequently, it has been discovered that if the side walls of the channel are formed parallel to each other rather than downwardly converging, and are spaced apart by a distance closely matching the thickness of the rail anchoring clips to be associated therewith, such movements of the clip can be minimised, if not eliminated.

The sleeper shown in FIG. 5 is cold rolled from steel strip, although it may be formed by other conventional ways of forming steel sections. The sleeper comprises two downwardly and outwardly inclined side walls 31 and upper wall portions 32 on either side of a longitudinally extending channel 33 which has opposed parallel side walls 34 and a bottom wall 35. The depth of the channel is in the order of 80 percent of the total height of the sleeper. With the embodiment illustrated, which has been developed primarily for light axle loadings such as encountered in tracks for sugarcane and mining railways, the sleeper is formed from 4 mm thick steel sheet, the width of the sleeper at the bottom thereof is in the order of 150 mm, the width of the top thereof is in the order of 90 mm, the total height is in the order of 50 mm, with a channel depth of in the order of 40 mm.

Having now described our invention, what we claim is:

1. An assembly comprising a footed rail, a sleeper, baseplate means having an underside and secured on the sleeper for locating the rail in a direction longitudinal of the sleeper, at least one rail anchoring clip means constructed of resilient material for longitudinally anchoring the rail across the sleeper, channel means extending longitudinally in the sleeper for locating the clip means in a direction lateral of the sleeper, said channel means including a bottom having an upper surface, said clip means being shaped when resiliently deformed for engaging the sleeper and anchoring the rail across the sleeper and defining a first portion that bears tightly against the upper surface of one side of the rail foot, a second portion that bears tightly against the underside of the baseplate means to compressibly anchor the rail on to the baseplate, and a third portion in co-operative engagement with the upper surface of the bottom of said channel means, said first portion being in line contact with the rail foot, said second portion being in line contact with the baseplate means, and said third portion being in line contact with the said upper surface, said line contacts being spaced apart in a direction longitudinal of the sleeper, wherein the first portion line contact is positioned further inward of the rail foot relative to the second portion line contact, and the third portion line contact is horizontally spaced outwardly of the rail from the second line contact whereby any tendency of the first portion of the clip means to slip down the upper surface of the rail foot causes the clip to tend to rotate about the second portion line contact to cause the third portion at its line contact to bear more tightly against the sleeper channel bottom upper surface to resist clip means movement the second portion being intermediate the first and third portions along the contour of said rail anchoring clip.

2. Assembly of claim 1, wherein said footed rail has two sides, with each side having an upper surface which is inclined from the rail foot upward toward the rail web.

3. Assembly of claim 1, wherein the baseplate means is secured to the sleeper and extends laterally of the sleeper over the channel means, said baseplate means having upturned flange means on each side thereof for locating the rail foot thereinbetween.

4. Assembly of claim 1, wherein the width of the channel means is such as to prevent displacement of the clip means laterally of the sleeper when the clip means is located within the channel means.

5. Assembly of claim 1 additionally including overdrive means for preventing on assembly overdrive of the clip means onto the rail and sleeper assembly.

6. Assembly of claim 5, wherein said first portion is provided with a tongue means having a free end for limiting the extent to which the means can be driven into position against the rail and sleeper by the free end abutting the web of the rail.

7. Assembly of claim 5, wherein said first portion is provided with a tongue means having a downwardly extending portion for limiting the extent to which the clip means can be driven into position against the rail and sleeper by said downwardly extending portion abutting an adjacent portion of the baseplate means.

8. Assembly of claim 1, wherein said channel means has side walls which are formed parallel to each other.

9. A rail anchoring clip adapted for co-operation in use with a footed rail, a sleeper, and a baseplate, said baseplate being secured across the sleeper and including locating means for locating the rail in a direction longitudinal of the sleeper, a longitudinally extending channel means in the sleeper for locating the anchoring clip in a direction lateral of the sleeper, said anchoring clip being formed of a strip of resilient material and providing when resiliently deformed in use a first portion means for tightly bearing against the upper surface of one side of the rail foot, a second portion means for tightly bearing against the underside of the baseplate to compressibly anchor the rail onto the baseplate, and a third portion means for cooperatively engaging said channel means to locate said clip laterally of the sleeper, said first portion means being arranged to form line contact with the rail, said second portion means being arranged to form line contact with the underside of the baseplate, and the third portion means being arranged to form line contact with the upper surface of the bottom of the channel means in the sleeper, wherein the line contact of said first portion means is positioned further inward of the rail foot relative to the line contact of the second portion means, and the line contact of the third portion means is horizontally spaced outwardly of the rail from the line contact of the second portion means, whereby any tendency of the first portion means of said clip to slip down the upper surface of the rail foot causes the clip to rotate about the line contact of the second portion means thus causing the third portion means at its line contact to bear more tightly against the upper surface of the bottom of the channel means the second portion being intermediate the first and third portions along the contour of said rail anchoring clip.

10. The clip of claim 9, wherein said first portion means has an extended portion with a free end, said free end abutting the web of the rail to limit the extent to which the anchoring clip can be driven into anchoring position against the rail and sleeper.

11. The rail anchoring clip of claim 9, wherein said first portion means is provided with a tongue having a downward extending portion which in use abuts an adjacent portion of the baseplate to limit the extent to which the anchoring clip can be driven into anchoring position against the rail and sleeper assembly.

12. An assembly comprising a footed rail, a sleeper, baseplate means having an underside and secured on the sleeper for locating the rail in a direction longitudinal of the sleeper, at least one rail anchoring clip means constructed of resilient material for longitudinally anchoring the rail across the sleeper, channel means extending longitudinally in the sleeper for locating the clip means in a direction lateral of the sleeper, said channel means including a bottom having an upper surface, said clip means being shaped when resiliently deformed for engaging the sleeper and anchoring the rail across the sleeper and defining a first portion that bears tightly against the upper surface of one side of the rail foot, a second portion that bears tightly against the underside of the baseplate means to compressibly anchor the rail on to the baseplate, and a third portion in co-operative engagement with the upper surface of the bottom of said channel means, said portions cooperating so that any tendency of the first portion of the clip means to slip down the upper surface of the rail foot causes the clip to tend to rotate about the second portion to cause the third portion to bear more tightly against the sleeper channel bottom upper surface to resist clip means movement the second portion being intermediate the first and third portions along the contour of said rail anchoring clip.

13. Assembly of claim 12, wherein said footed rail has two sides, with each side having an upper surface which is inclined from the rail foot upward toward the rail web.

14. Assembly of claim 12, wherein the baseplate means is secured to the sleeper and extends laterally of the sleeper over the channel means, said baseplate means having upturned flange means on each side thereof for locating the rail foot thereinbetween.

15. Assembly of claim 12, wherein the width of the channel means is such as to prevent displacement of the clip means laterally of the sleeper when the clip means is located within the channel means.

16. Assembly of claim 12 additionally including overdrive means for preventing on assembly overdrive of the clip means onto the rail and sleeper assembly.

17. Assembly of claim 16, wherein said first portion is provided with a tongue means having a free end for limiting the extent to which the means can be driven into position against the rail and sleeper by the free end abutting the web of the rail.

18. Assembly of claim 16, wherein said first portion is provided with a tongue means having a downwardly extending portion for limiting the extent to which the clip means can be driven into position against the rail and sleeper by said downwardly extending portion abutting an adjacent portion of the baseplate means.

19. Assembly of claim 12, wherein said channel means has side walls which are formed parallel to each other.

20. A rail anchoring clip adapted for co-operation in use with a footed rail, a sleeper, and a baseplate, said baseplate being secured across the sleeper and including locating means for locating the rail in a direction longitudinal of the sleeper, a longitudinally extending channel means in the sleeper for locating the anchoring clip in a direction lateral of the sleeper, said anchoring clip being formed of a strip of resilient material and providing when resiliently deformed in use a first portion means for tightly bearing against the upper surface of one side of the rail foot, a second portion means for tightly bearing against the underside of the baseplate to compressibly anchor the rail onto the baseplate, and a third portion means for cooperatively engaging said upper surface of the bottom of the channel means to locate said clip laterally of the sleeper, said portions cooperating so that any tendency of the first portion means of said clip to slip down the upper surface of the rail foot causes the clip to tend to rotate about the second portion means thus causing the third portion means to bear more tightly against the upper surface of the bottom of the channel means the second portion being intermediate the first and third portions along the contour of said rail anchoring clip.

21. The clip of claim 20, wherein said first portion means has an extended portion with a free end, said free end abutting the web of the rail to limit the extent to which the anchoring clip can be driven into anchoring position against the rail and sleeper.

22. The rail anchoring clip of claim 20, wherein said first portion means is provided with a tongue having a downward extending portion which in use abuts an adjacent portion of the baseplate to limit the extent to which the anchoring clip can be driven into anchoring position against the rail and sleeper assembly.

* * * * *